US007903069B2

(12) United States Patent
Kwon et al.

(10) Patent No.: US 7,903,069 B2
(45) Date of Patent: Mar. 8, 2011

(54) LCD DRIVER INTEGRATED CIRCUIT HAVING DOUBLE COLUMN STRUCTURE

(75) Inventors: Jae-Wook Kwon, Yongin-si (KR); Seung-Jung Lee, Seoul (KR)

(73) Assignee: Samsung Electronics Co., Ltd. (KR)

( * ) Notice: Subject to any disclaimer, the term of this patent is extended or adjusted under 35 U.S.C. 154(b) by 759 days.

(21) Appl. No.: 11/467,597

(22) Filed: Aug. 28, 2006

(65) Prior Publication Data

US 2007/0140014 A1 Jun. 21, 2007

(30) Foreign Application Priority Data

Dec. 20, 2005 (KR) ..... 10-2005-0126078

(51) Int. Cl.
*G09G 3/36* (2006.01)

(52) U.S. Cl. ..... 345/98; 345/99

(58) Field of Classification Search ..... 345/87–104, 345/204–206, 76–83; 349/139, 149–152; 315/169.1–169.2
See application file for complete search history.

(56) References Cited

U.S. PATENT DOCUMENTS 6,603,527 B1 * 8/2003 Hayata et al. ..... 349/152
6,791,526 B2 * 9/2004 Kubota et al. ..... 345/100
2002/0030656 A1 * 3/2002 Goto et al. ..... 345/89
2004/0104880 A1 * 6/2004 Kang et al. ..... 345/94
2004/0239659 A1 * 12/2004 Toriumi et al. ..... 345/204

FOREIGN PATENT DOCUMENTS

JP 2002-352593 A 12/2002
JP 2005-181376 A 7/2005
KR 10-0356811 B1 10/2002

* cited by examiner

*Primary Examiner* — Chanh Nguyen
*Assistant Examiner* — Long Pham
(74) *Attorney, Agent, or Firm* — Myers Bigel Sibley & Sajovec

(57) ABSTRACT

A driver integrated circuit (IC) for a liquid crystal display (LCD) has a double column structure. The driver IC includes a first shift register unit, a first data latch unit, first and second decoders, and first and second output buffers. The first data latch unit receives and stores first and second group channel data in response to a clock signal generated by the first shift register unit. The first decoder receives the first group channel data and outputs gamma voltages corresponding to the first group channel data. The second decoder receives the second group channel data and outputs gamma voltages corresponding to the second group channel data. The first and second output buffers are aligned along a long edge of the driver IC and buffer the corresponding gamma voltages to drive corresponding channels. The first shift register unit and the first data latch unit are shared by upper and lower blocks to process the first and second group channel data together.

12 Claims, 10 Drawing Sheets

LCD DRIVER INTEGRATED CIRCUIT HAVING DOUBLE COLUMN STRUCTURE

CROSS-REFERENCE TO RELATED PATENT APPLICATION

This application claims the benefit under 35 USC §119 of Korean Patent Application No. 10-2005-0126078, filed on Dec. 20, 2005, the disclosure of which is hereby incorporated herein by reference in its entirety as if set forth fully herein.

FIELD OF THE INVENTION

The present invention relates to liquid crystal displays (LCDs), and more particularly, to an LCD driver integrated circuit (LDI) that drives an LCD.

BACKGROUND OF THE INVENTION

In general, a liquid crystal display (LCD) includes an LCD panel, a gate driver, and a source driver. The LCD panel may include a lower glass substrate (TFT array) on which thin transistors and pixel electrodes are arranged; an upper glass substrate that includes a color filter for color representation, and common electrodes; and a liquid crystal between the lower and upper glass substrates. Also, a polarizing plate that linearly polarizes visible light may be attached to the both side surfaces of the upper and lower glass substrates.

In the TFT array, a plurality of source lines and a plurality of gate lines are arranged to connect pixels in the form of a matrix. Each pixel may have a thin film transistor (TFT) and a capacitor.

The gate driver sequentially drives the gate lines of the TFT-LCD panel. The source driver transforms digital data (source data), which may be a video signal, into analog voltages to drive the source lines of the LCD panel.

FIG. 1 is a block diagram of a general LCD driver integrated circuit (LDI) 100. Referring to FIG. 1, the LDI 100 includes a reduced swing differential signaling (RSDS) receiver 110, a data register unit 120, a shift register unit 130, a data latch unit 140, a decoder 150, and an output buffer 160.

The RSDS receiver 110 receives a plurality of digital signals D00P, D00N, D01P, D01N, . . . , D22P, and D22N from a central processing unit (CPU) (not shown). The digital signals D00P, D00N, D01P, D01N, . . . , D22P, and D22N may be transmitted according to an RSDS method. The data register unit 120 receives and stores in parallel 3×N bit digital data from the RSDS receiver 110 (N denotes the number of bits for each channel). Here, N is set to 6. That is, it is assumed that each channel data is 6 bits long.

Data stored in the data register unit 120 are transmitted to the data latch unit 140 in response to latch clock signals received from the shift register unit 130. When channel data regarding all channels (n channels) is stored in the data latch unit 140, the data latch unit 140 transmits n×N bit data to the decoder 150 in response to a first clock signal CLK1 (n denotes the number of channels).

The decoder 150 receives n channel data from the data latch unit 140 at a time, and outputs gamma voltages corresponding to the n channel data, respectively. The output buffer 160 buffers the gamma voltages from the decoder 150 to generate driving voltages $Y_1, Y_2, Y_3, \ldots, Y_{n-2}, Y_{n-1}$, and $Y_n$, and outputs the driving voltages $Y_1, Y_2, Y_3, \ldots, Y_{n-2}, Y_{n-1}$, and $Y_n$ to corresponding source lines (channels).

The LDI 100 further includes a logic controller (not shown). The logic controller controls the operation of the LDI 100 in response to control signals output from the CPU.

FIG. 2 is a block diagram of a conventional LDI 200. Referring to FIG. 2, like general LDIs, the conventional LDI 200 includes shift register units 210*a* and 210*b*, data latch units 220*a* and 220*b*, decoders 230*a* and 230*b*, output buffers 240*a* and 240*b*, and a logic controller 250. The conventional LDI 200 further includes an input signal pad unit 260 via which external signals are received. Other components also may be included.

In a conventional LDI 200, the shift register units 210*a* and 210*b*, the data latch units 220*a* and 220*b*, the decoders 230*a* and 230*b*, and the output buffers 240*a* and 240*b* are located in a line to the right and left sides of the logic controller 250, respectively. That is, the logic controller 250 is located at the center of the Integrated Circuit (IC) chip; a first group of the shift register unit 210*a* the data latch unit 220*a*, the decoder 230*a*, and the output buffer 240*a* are arranged in a line to the left side of the logic controller 250; and a second group of the shift register unit 210*a*, the data latch unit 220*a*, the decoder 230*a*, and the output buffer 240*a* are arranged in a line to the right side of the logic controller 250.

Conventional LDIs generally have the above in-line structure in which output buffers are arranged in a line along a long edge of the chip, and therefore, the more channels, the longer the long edge of the LDI. Accordingly, in the conventional LDIs, a long edge may be ten times longer than a short edge, and the more channels, the poorer the output characteristics between channels may be and/or the more difficult the chip fabrication may be. The length of a long edge of the LDI may also cause serious restrictions to a large-scale panel, e.g., a display system, which needs more than one LDI.

SUMMARY OF THE INVENTION

Some embodiments of the present invention can provide a small-sized driver Integrated Circuit (IC) for a liquid crystal display (LCD), which can have improved output characteristics between channels, and an LCD having the same.

According to some embodiments of the present invention, there is provided a driver IC for an LCD. The driver IC includes a first shift register unit, a first data latch unit, first and second decoders, and first and second output buffers. The first data latch unit is configured to receive and store first and second group channel data in response to a clock signal generated by the first shift register unit. The first decoder is configured to receive the first group channel data and to output gamma voltages corresponding to the first group channel data. The second decoder is configured to receive the second group channel data and to output gamma voltages corresponding to the second group channel data. The first output buffer is located along a first long edge of the driver IC, and is configured to buffer the gamma voltages corresponding to the first group channel data to drive corresponding channels of the LCD. The second output buffer is located along a second long edge of the driver IC, and is configured to buffer the gamma voltages corresponding to the second group channel data to drive corresponding channels of the LCD.

The first shift register unit may be shifted in a first direction to generate a first latch clock signal, and changed to be shifted in a second direction to generate a second latch clock signal. The shifting direction of the first shift register unit is changed in response to a direction control signal being generated in the driver IC.

According to other embodiments of the present invention, there is provided a driver IC for an LCD. The driver IC includes a shift register unit, a data latch unit, a plurality of decoders, and a plurality of output buffers. The data latch unit is configured to receive and store channel data in response to latch clock signals being generated by the shift register unit. The decoders are configured to decode the channel data and to output gamma voltages corresponding to the decoded channel data. The output buffers are configured to buffer the gamma voltages to generate driving voltages. Also, the decoders and the output buffers are dispersed in first through fourth blocks. The output buffers of the first through fourth blocks are aligned closely (i.e., closely spaced apart from) to the long edges of the driver IC.

In other embodiments, a logic controller may further be included at the center of the driver IC, the first and second blocks may be respectively located on an upper part and a lower part of a first area with respect to the logic controller, and the third and fourth blocks may be respectively located on an upper part and a lower part of a second area with respect to the logic controller. The shift register unit and the data latch unit may be dispersed in the first through fourth blocks.

Driver integrated circuits for a liquid crystal display according to yet other embodiments of the invention comprise a rectangular driver integrated circuit chip for the liquid crystal display that includes first and second opposing long edges and first and second opposing short edges. A first output buffer for the liquid crystal display is provided in the rectangular driver integrated circuit chip that is adjacent, and extends along, the first long edge. A second output buffer for the liquid crystal display is provided in the rectangular driver integrated circuit chip that is adjacent, and extends along, the second long edge.

In other embodiments, a first decoder and a second decoder for the liquid crystal display are provided in the rectangular driver integrated circuit chip between the first and second output buffers, and a data latch and a shift register for the liquid crystal display are provided in the rectangular driver integrated circuit chip between the first and second decoders. In still other embodiments, a first decoder and a second decoder for the liquid crystal display are provided in the rectangular driver integrated circuit chip between the first and second output buffers. A first data latch and a second data latch for the liquid crystal display are provided in the rectangular integrated circuit chip between the first and second decoders. Finally, a first shift register and a second shift register for the liquid crystal display are provided in the rectangular driver integrated circuit chip between the first and second data latches.

In still other embodiments, the first and second output buffers are also adjacent the first short edge. The driver integrated circuit further includes a third output buffer for the liquid crystal display in the rectangular driver integrated circuit that is adjacent, and extends along, the first edge, and a fourth output buffer for the liquid crystal display in the rectangular driver integrated circuit chip that is adjacent, and extends along, the second long edge, The third and fourth buffers are also adjacent the second short edge.

BRIEF DESCRIPTION OF THE DRAWINGS

The above and other aspects and advantages of the present invention will become more apparent by describing in detail exemplary embodiments thereof with reference to the attached drawings in which.

FIG, 8A is a timing diagram for explaining how the 1-bit data latch unit of FIG. 6 receives and latches channel data from a data register according to some embodiments of the invention.

DETAILED DESCRIPTION OF THE INVENTION

Figure 1:
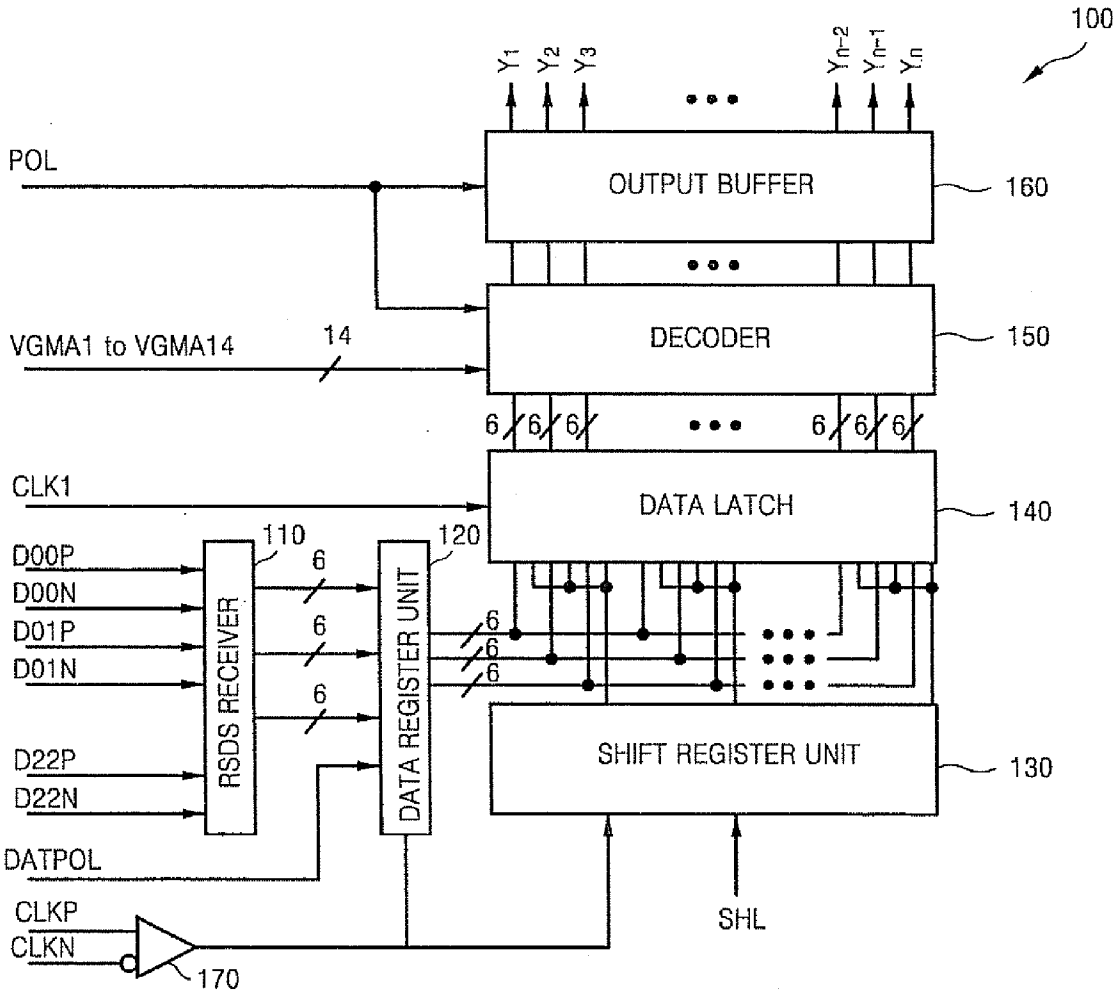
FIG. 1(PRIOR ART)
FIG. 1 is a block diagram of a general liquid crystal display driver integrated circuit (LDI)

The present invention is described more fully hereinafter with reference to the accompanying drawings, in which example embodiments of the invention are shown. The present invention may, however, be embodied in many different forms and should not be construed as limited to the example embodiments set forth herein. Rather, these example embodiments are provided so that this disclosure will be thorough and complete, and will fully convey the scope of the present invention to those skilled in the art. In the drawings, the sizes and relative sizes of layers and regions may be exaggerated for clarity.

It will be understood that when an element or layer is referred to as being "on," "connected to," "coupled to" or "responsive to" another element or layer, it can be directly on, connected, coupled or responsive to the other element or layer or intervening elements or layers may be present. In contrast, when an element is referred to as being "directly on," "directly connected to," "directly coupled to" or "directly responsive to" another element or layer, there are no intervening elements or layers present. Like numbers refer to like elements throughout. As used herein, the term "and/or" includes any and all combinations (mixtures) of one or more of the associated listed items and may be abbreviated as "/".

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The structure and/or the device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments of the present invention are described herein with reference to plan view illustrations that are schematic illustrations of idealized embodiments of the present invention. As such, variations from the shapes of the illustrations as a result, for example, of manufacturing techniques and/or tolerances, are to be expected. Thus, example embodiments of the present invention should not be construed as limited to the particular shapes of regions illustrated herein but are to include deviations in shapes that result, for example, from manufacturing. Thus, the regions illustrated in the figures are schematic in nature and their shapes are not intended to illustrate the actual shape of a region of a device and are not intended to limit the scope of the present invention unless expressly so defined herein.

It should also be noted that in some alternate implementations, the functionality of a given block may be separated into multiple blocks and/or the functionality of two or more blocks may be at least partially integrated.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and the present application, and will not be interpreted in an idealized or overly formal sense unless expressly so defined herein.

Figure 3:
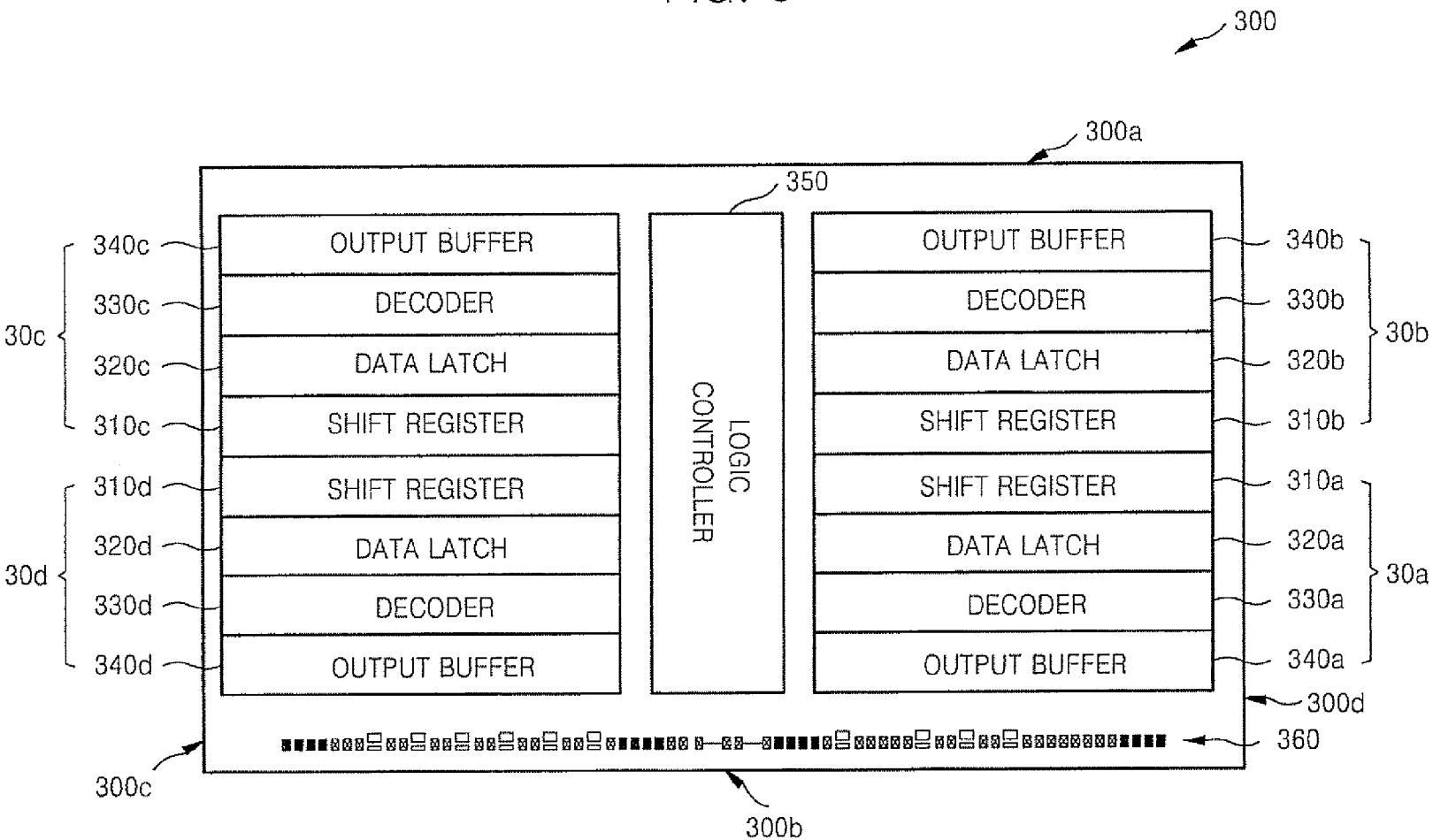
FIG. 3 is a block diagram of an LDI according to some embodiments of the present invention.

FIG. 3 is a block diagram of a liquid crystal display driver integrated circuit (LDI) 300 according to some embodiments of the present invention. Referring to FIG. 3, the LDI 300 includes a logic controller 350, first through fourth blocks 30*a*, 30*b*, 30*c*, and 30*d*, and an input signal pad unit 360.

The logic controller 350 controls the operation of the LDI 300 in response to control signals (not shown) received from a central processing unit (CPU) (not shown). The input signal pad unit 360 includes a plurality of pads via which external signals are received. Also, although not shown in FIG. 3, like the general LDI 100, the LDI 300 may further include a data receiver (for example, a reduced swing differential signaling (RSDS) receiver) and a data register. The data receiver and the data register may be located close to the input signal pad unit 360. Other components also may be provided.

The first through fourth blocks 30*a*, 30*b*, 30*c*, 30*d* include shift register units 310*a*, 310*b*, 310*c*, and 310*d*, data latch units 320*a*, 320*b*, 320*c*, and 320*d*, decoders 330*a*, 330*b*, 330*c*, and 330*d*, and output buffers 340*a*, 340*b*, 340*c*, and 340*d*.

The first and second blocks 30*a* and 30*b* are located on a first area (illustrated in FIG. 3 as the right side of the logic controller 350) with respect to the logic controller 350, and the third and fourth blocks 30*c* and 30*d* are located on the opposite area (illustrated in FIG. 3 as the left side of the logic controller 350). For example, the first block 30*a* is located at the right bottom of the LDI 300, and the second through fourth blocks 30*b*, 30*c*, and 30*d* are sequentially located counterclockwise from the first block 30*a*.

Thus, the LDI 300 may be regarded as having a double column structure in which an upper part of one chip, such as the conventional LDI 200, is combined with a lower part of another chip, such as the conventional LDI 200, to be symmetric about an X-axis. Signals output from each output buffer may head for a long edge 300*a*, 300*b* of the chip, that is, the output buffers 340*a*, 340*b*, 340*c*, and 340*d* are located close to the long edges 300*a*, 300*b* of the chip. Therefore, the shift registers 310*a* and 310*b* are arranged to face the shift registers 310*c* and 310*d* at the center of the chip. Specifically, the shift registers 310*a*, 310*b*, 310*c*, and 310*d*, the data latch units 320*a*, 320*b*, 320*c*, and 320*d*, the decoder 330*a*, 330*b*, 330*c*, and 330*d*, and the output buffers 340*a*, 340*b*, 340*c*, and 340*d* are sequentially located in a direction from the center of the chip to an edge thereof.

Basic operations of an LDI 300 according to some embodiments of the present invention will now be described. In the LDI 300, channel data delivered to a data receiver (e.g., an RSDS receiver) (not shown) is stored in a data register (not shown), and transmitted to the data latch units 320*a*, 320*b*, 320*c*, and 320*d* in response to latch clock signals generated by the shift register units 310*a*, 310*b*, 310*c*, and 310*d*. When all the channel data is supplied to the data latch units 320*a*, 320*b*, 320*c*, and 320*d*, the channel data is transmitted to the decoders 330*a*, 330*b*, 330*c*, and 330*d* in response to a main output clock signal CLK1. The decoders 330*a*, 330*b*, 330*c*, and 330*d* output gamma voltages corresponding to the respective channel data, and the output buffers 340*a*, 340*b*, 340*c*, and 340*d* buffer the gamma voltages and apply the buffered gamma voltages to an LCD panel (not shown). The above basic operations of the LDI 300 may be the same as those of the general LDI 100.

Figure 2:
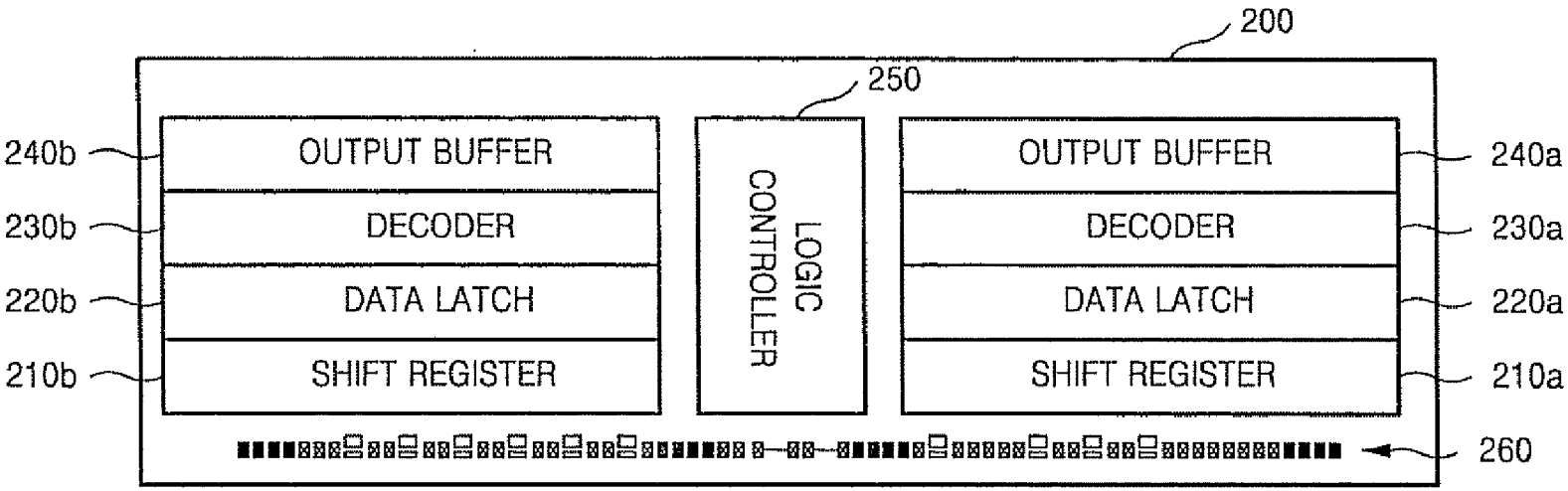
FIG. 2(PRIOR ART)
FIG. 2 is a block diagram of a conventional LDI.

However, the structure of the LDI 300 also may be different from that of a conventional LDI. Since the internal circuits of the LDI 300 according to some embodiments of the present invention are arranged as illustrated in FIG. 3, the integration degree of the LDI 300 may be higher than that of a conventional LDI (such as the LDI 200 of FIG. 2) in which output buffers are aligned along a single long edge of the chip. Further, the number of channels in the LDI 300 according to some embodiments of the present invention can double that of channels in the conventional LDI 200 but the lengths of the long edges 300*a*, 300*b* of the LDI 300 may be equal to those of the long edges of the conventional LDI 200. In other words, given the same number of channels, the lengths of the long edges 300*a*, 300*b* of the LDI 300 may be about half those of the long edges of the LDI 200, which can improve the output characteristics between channels.

As illustrated in FIG. 3, the shift register units 310*a* through 310*d* are connected in series and in the vertical direction, and may be sequentially driven according to the same timing. Therefore, if upper and lower blocks share the shift register units 310*a* through 310*d*, the chip size can be significantly reduced.

Still referring to FIG. 3, a driver integrated circuit for an LCD according to some embodiments of the present invention can include a rectangular driver integrated circuit chip 300 for the LCD that includes first and second opposing long edges 300*a*, 300*b*, respectively, and first and second opposing short edges 300*c*, 300*d*, respectively. A first output buffer 340*c* for the liquid crystal display is provided in the rectangular driver integrated circuit chip 300 that is adjacent and extends along, the first long edge 300*a*. A second output buffer 340*d* for the liquid crystal display is provided in the rectangular driver integrated circuit chip 300 that is adjacent, and extends along, the second long edge 300*b*. In some embodiments, a first decoder and a second decoder 330*c*, 300*d* for the LCD are provided in the rectangular driver integrated circuit chip 300, between the first and second buffers 340*c*, 340*d*, respectively. A data latch 320*c* and a shift register 310*c*, 310*d* for the LCD are also provided in the rectangular driver integrated circuit chip 300 between the first and second decoders 330*c*, 300*d*.

More specifically, in some embodiments, a first decoder 330*c* and a second decoder 330*d* are provided between the first and second output buffers 340*c*, 340*d*. A first data latch 320*c* and a second data latch 320*d* are provided between the first and second decoders 330*c*, 330*d*. Finally, a first shift register 310*c* and a second shift register 310*d* are provided between the first and second data latches 320*c*, 320*d*.

In other embodiments, the first and second output buffers 340*c*, 340*d* are also adjacent a first short edge 300*c* of the rectangular driver integrated circuit chip 300, and a third output buffer 340*b* and a fourth output buffer 340*a* are provided. The third output buffer 340*b* is adjacent and extends along the first long edge 300*a* and is also adjacent a second short edge 300*d* of the rectangular driver integrated circuit chip 300. The fourth output buffer 340*a* is adjacent and extends along the second long edge 300*b* and is also adjacent the second short edge 300*b* of the rectangular driver integrated circuit chip 300.

Figure 4:
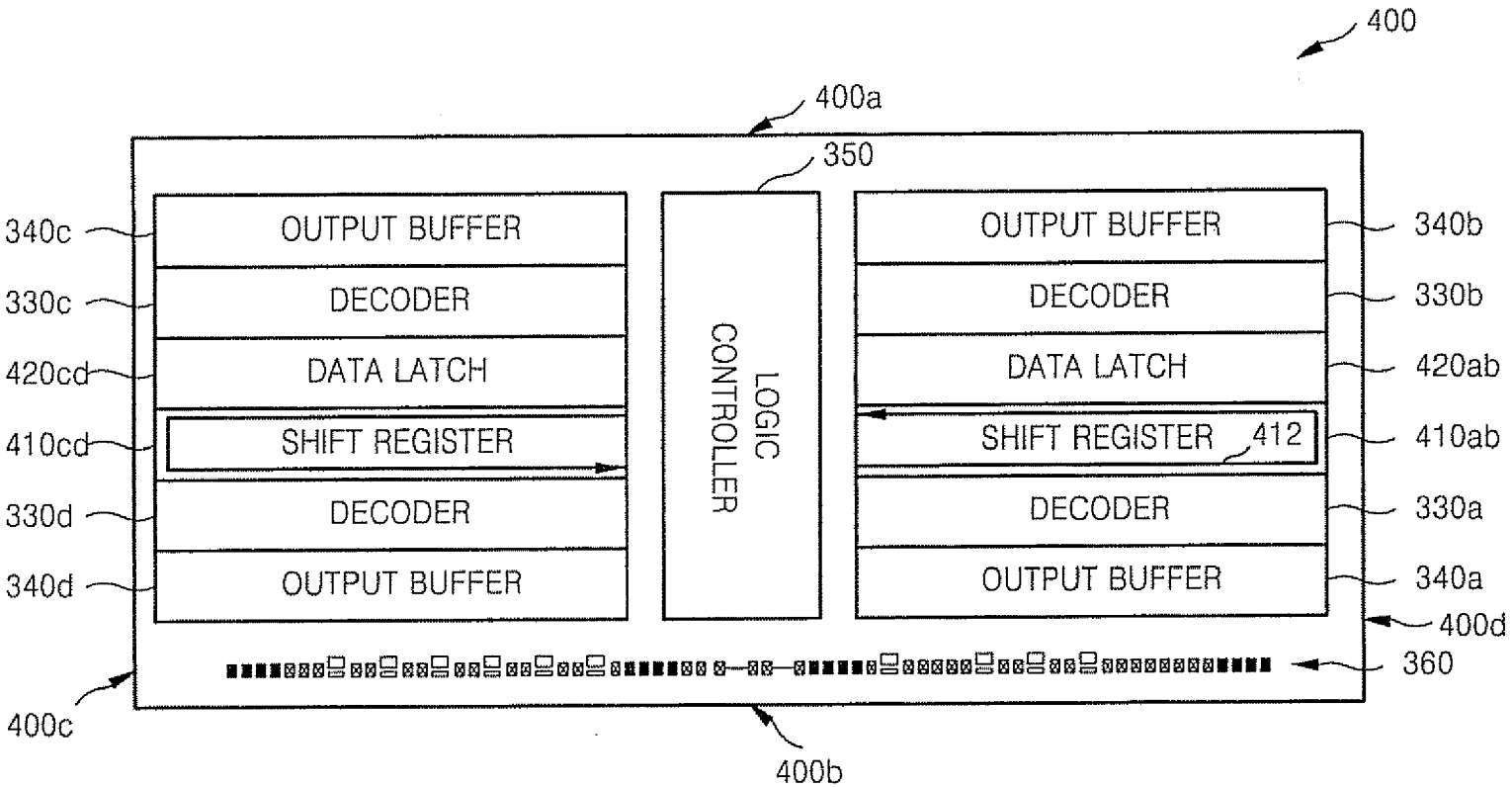
FIG. 4 is a block diagram of an LDI according to other embodiments of the present invention.

FIG. 4 is a block diagram of an LDI 400 according to other embodiments of the present invention. Referring to FIG. 4, the construction of the LDI 400 may be similar to that of the LDI 300 of FIG. 3.

However, the LDI 400 according to these other embodiments of the present invention may be differentiated from the LDI 300 according to previously described embodiments of the present invention in that upper and lower blocks share shift register units and/or data latch units. Specifically, first and second blocks share a shift register unit 410*ab* and/or a data latch unit 420*ab*, and third and fourth blocks share a shift register unit 410*cd* and/or a data latch unit 420*cd*. That is, in the LDI 400, the upper and lower blocks share both a shift register unit and a data latch unit. In other embodiments, they may only share the shift register unit or the data latch unit.

In a conventional LDI 200, the shift register units 210*a* and 210*b* generally are fixed in a direction. The direction of the shift register units 210*a* and 210*b* can be controlled by using an external direction control signal SHL. When the LDI 200 is mounted on an LCD, the direction control signal SHL is maintained at a high logic level or a low logic level. Thus, the shift register units 210*a* and 210*b* are also fixed in a direction.

In contrast, in an LDI 400 according to some embodiments of the present invention, a direction in which the shift register units 410*ab* and 410*cd* are shifted can be internally controlled. That is, in the LDI 400, even if an external direction control signal SHL is maintained at the logic high level or the logic low level, the shifting direction of the shift register units 410*ab* and 410*cd* can be changed by using an internal direction control signal (not shown) generated in the chip.

Thus, according to some embodiments of the present invention, the number of bits of the shift register units 410*ab* and 410*cd* need not be equal to the number of the channels. Since a general RSDS receiver receives 3-channel data (18-bit data) for each clock signal, the number of bits of a general shift register unit may be ⅓ of the number n of channels. Assuming that the number n of channels is 1026, the number of bits of the shift register units 210*a* and 210*b* of the conventional LDI 200 may total 1026/3=342. That is, a 342-bit shift register unit 130 may be needed.

However, in the LDI 400, the shift register units 410*ab* and 410*cd* are shared by the upper and lower blocks, and each register of the shift register units 410*ab* and 410*cd* can generate two latch clock signals LATCLK. Therefore, ideally, a number of shift registers may be reduced to one half a number of shift registers that the conventional LDI 200 uses. However, since a timing section for changing the direction of a shift register at an edge of the chip may be needed, 1-bit redundancy shift register or a 2-bit redundancy shift register may further be added. Accordingly, in some embodiments of the present invention, the number L of bits of the shift register units 410*ab* and 410*cd* may be determined by:

$$L=[n/(k\times 2)]+r \quad (1),$$

wherein n denotes a total number of channels, k denotes the number of channels that the RSDS receiver receives at a time (for example, k is 3), r denotes the number of redundancy shift registers (for example, r is 1 or 2), and [ ] denotes roundup in which when n/(k×2) is not an integer, a next higher integer that is greater than n/(k×2) is computed.

Assuming that the number of the channels is 1026, in some embodiments of the present invention, the number of shift registers constituting the shift register units 410*ab* and 410*cd* may be 1026/6+1=172 or 1026/6+2=173.

The shift register units 410*ab* and 410*cd* generate latch clock signals to be sequentially activated at intervals of a clock cycle. More specifically, the shift register units 410*ab* and 410*cd* are shifted in a direction to generate latch clock signals, and then changed to be shifted in another direction to generate latch clock signals. In this case, a direction control signal may be internally changed in the chip to change the shifting directions of the shift register units 410*ab* and 410*cd*.

Embodiments of the invention that are illustrated in FIG. 4 may also be regarded as providing driver integrated circuits for liquid crystal displays that include a rectangular driver integrated circuit chip 400 for the liquid crystal display that includes first and second opposing long edges 400*a*, 400*b*, respectively, and first and second opposing short edges 400*c*, 400*d*, respectively. A first output buffer 340*c* for the LCD is provided in the rectangular driver integrated circuit chip 400 that is adjacent and extends along the first long edge 400*a*. A second output buffer 340*d* for the LCD is provided in the rectangular driver integrated circuit 400 that is adjacent and extends along the second long edge 400*b*.

These embodiments may also be regarded as including a first decoder 330*c* and a second decoder 330*d* for the LCD in the rectangular driver integrated circuit chip 400 between the first and second output buffers 340*c*, 340*d*, respectively, and a data latch 420*cd* and a shift register 410*cd* for the liquid crystal display in the rectangular driver integrated circuit chip 400 between the first and second decoders 300*c*, 330*d*, respectively.

These embodiments may also be regarded as including a third output buffer 400*d* for the LCD in the rectangular driver integrated circuit chip 400 that is adjacent and extends along the first long edge 400*a*, and is also adjacent the second short edge 400*d*, and a fourth output buffer 340*a* for the LCD in the rectangular driver integrated circuit chip 400 that is adjacent and extends along the second long edge 400*b* and also is adjacent the second short edge 400*d*.

Figure 5A:
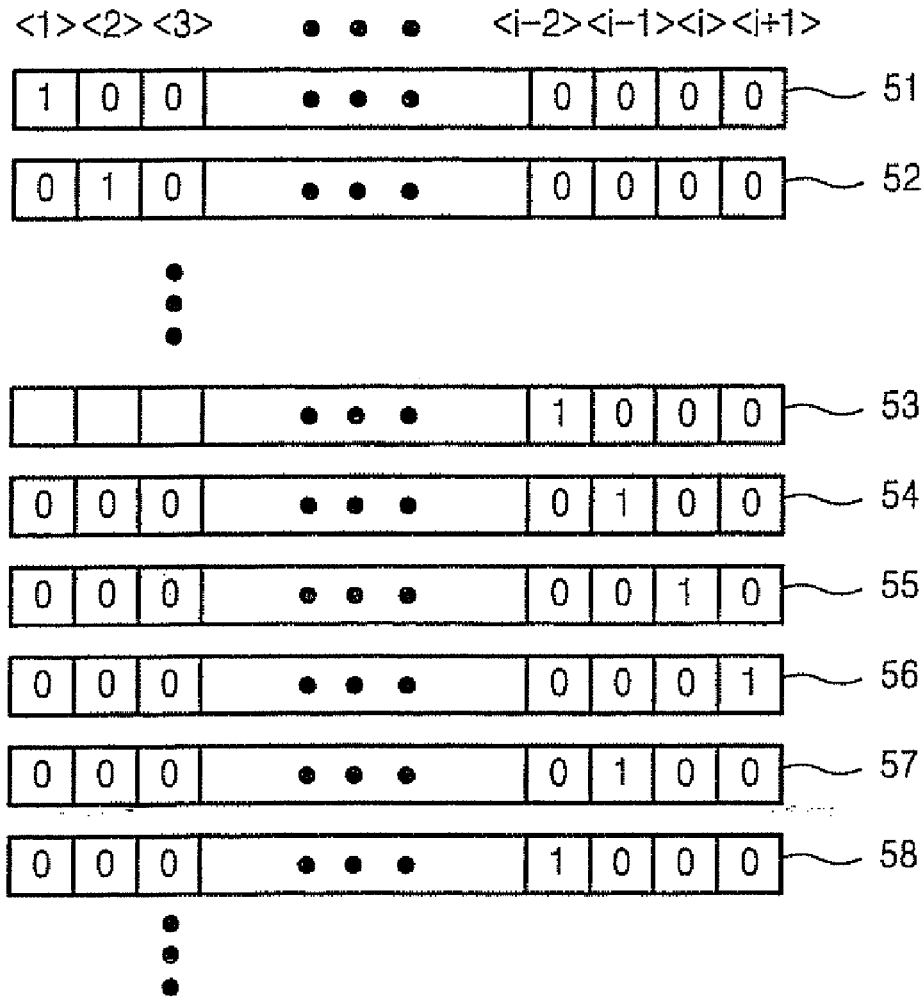
FIG. 5A is a diagram illustrating states of a shift register unit of FIG. 4 according to some embodiments of the present invention.
Figure 5B:
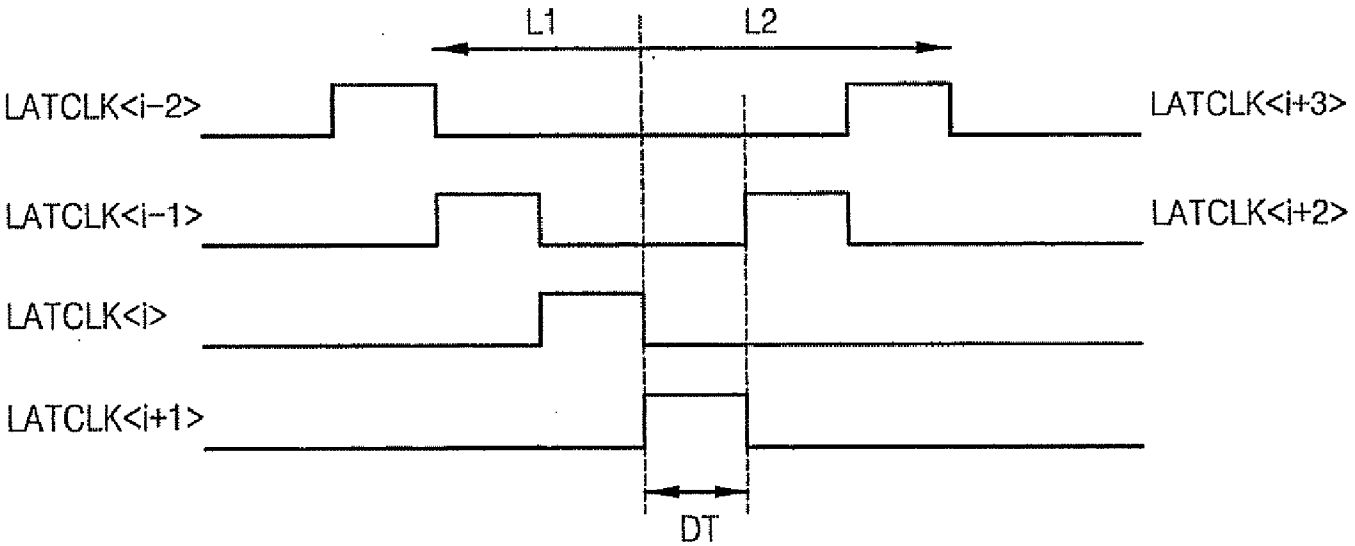
FIG. 5B is a timing diagram of latch clock signals generated by the shift register unit of FIG. 4 according to some embodiments of the invention.

FIG. 5A is a diagram illustrating states of the shift register unit 410*ab* of FIG. 4 according to some embodiments of the present invention. FIG. 5B is a timing diagram of latch clock signals generated by the shift register unit 410*ab* of FIG. 4 according to some embodiments of the present invention.

Referring to FIG. 5A, the shift register unit 410*ab* performs sequential bit shifting in a direction from a first bit shift register <1> to an i+1$^{th}$ bit shift register <i+1> (illustrated as the right direction) (51 through 56). First group channel data is latched by the data latch unit 420*ab*, in response to latch clock signals LATCLK<1>, . . . , LATCLK<i−2>, LATCLK<i−1>,and LATCLK<i> generated when the first bit shift register <1> to an i$^{th}$ bit shift register <i> perform bit shifting, respectively (L1 of FIG. 5B). The first group channel data is channel data to be supplied to an LCD panel via the decoder 330*a* and the output buffer 340*a* of the first block.

After bit shifting by the i+1$^{th}$ bit shift register <i+1> is completed (56), the shift register unit 410*ab* changes the shifting direction and an i−1$^{th}$ shift register performs bit shifting (57). That is, the internal direction control signal is changed for a time interval DT between the latch clock signal LATCLK<i+1> and the next latch clock signal LATCLK<i+2>, thus changing the shifting direction of the shift register unit 410*ab*. Thus, bit shifting is sequentially performed by the i−1$^{th}$ bit shift register <i−1> to the first shift register <1>.

Second group channel data is latched by the data latch unit 420*ab*, in response to latch clock signals LATCLK<i+2>, LATCLK<i+3>, . . . generated when bit shifting is sequentially performed by the i+1$^{th}$ bit shift register <i+1> and from the i−1$^{th}$ bit shift register <i−1> to the first shift register <1> (L2 of FIG. 5B). The second group channel data is channel data to be supplied to the LCD panel via the decoder 330*b* and the output buffer 340*b* of the second block.

As described above, according to some embodiments of the present invention, an upper block and a lower block share a shift register unit, and thus, a latch clock signal may be activated twice by a 1-bit shift register. In this case, since a shift register generally cannot continuously generate two latch clock signals, a redundancy shift register <i+1> is further added.

The operation of the shift register unit 410*cd* may also be similar to that of the shift register unit 410*ab*, and thus, a detailed description of the shift register unit 410*cd* will be omitted.

The overall operations of the shift register units 410*ab* and 410*cd* will now be summarized with reference to FIG. 4. Referring to FIG. 4, bit shifting is performed in, for example, the right direction starting from a left first register of the shift register unit 410*ab* shared by the first and second blocks, marked by an arrow 412, and the direction of bit shifting is changed to, for example, the left direction starting from a right last register<i+1>. Thus, bit shifting is performed in the left direction, the direction of bit shifting is changed again from a left last register in the right direction, and then, bit shifting is performed in the right direction. For change of the shifting direction, the logic level of the internal direction control signal is sequentially changed to a logic high level H→a logic low level L→the logic high level H, or to the logic low level L→the logic high level H→the logic low level L.

Figure 6:
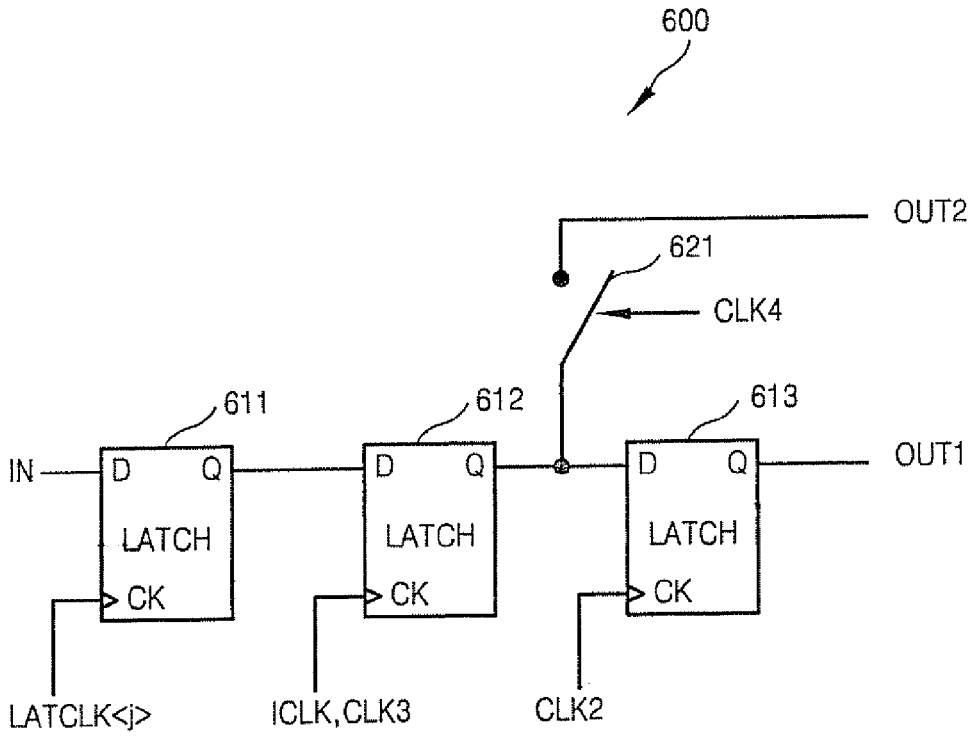
FIG. 6 is a detailed circuit diagram of a 1-bit data latch unit that can constitute a data latch unit of FIG. 4 according to some embodiments of the invention.

FIG. 6 is a detailed circuit diagram of a 1-bit data latch unit 600 that may constitute the data latch unit of FIG. 4, according to some embodiments of the present invention. FIG. 6 illustrates the 1-bit bit data latch unit 600 that latches 1-bit data according to some embodiments of the present invention. Therefore, the number of 1-bit data latch units 600 included in the data latch units 420*ab* and 420*cd* may be equal to (number of channels×number of bits).

The data latch units 420*ab* and 420*cd* latch and store channel data from a data register (not shown) in units of a specific bit value, e.g., 18 bits, and output the stored channel data to the decoders 330*a*, 330*b*, 330*c*, and 330*d* in parallel in units of the number of the channels, i.e., (the number of channels× number of bits). Specifically, the data latch unit 420*ab* that the first and second blocks share, latches and stores first and second group channel data in response to a corresponding latch clock signal, and outputs the first group channel data to the corresponding decoder 330*a* and second group channel data to the corresponding decoder 330*b* in response to a main output clock signal CLK1. The data latch unit 420*cd* that third and fourth blocks share, latches and stores third and fourth group channel data in response to a corresponding latch clock signal, and outputs the third group channel data to the corresponding decoder 330*c* and the fourth group channel data to the corresponding decoder 330*d* in response to the main output clock signal CLK1.

The 1-bit data latch unit 600 includes first through third latches 611, 612, and 613, and a switch 621.

Figure 8A:
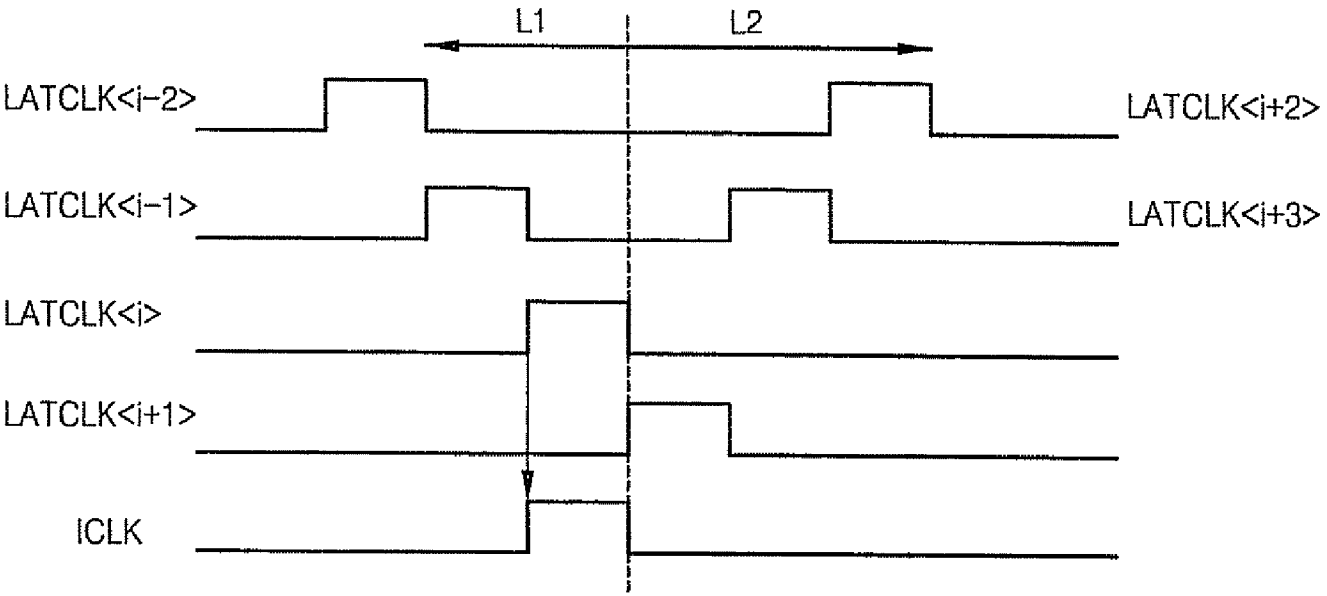
FIG. 8B is a timing diagram of output data latched by the 1-bit data latch unit of FIG. 6 according to some embodiments of the invention.

FIG. 8A is a timing diagram for explaining how the 1-bit data latch unit of FIG. 6 receives and latches channel data from a data register (not shown) according to some embodiments of the present invention.

Receiving and latching channel data by the 1-bit data latch unit 600 from the data register will now be described with reference to FIGS. 6 and 8A.

First, latch clock signals LATCLK<1> through LATCLK<i> are sequentially generated to latch a group of channel data (first group channel data), and a first latch 611 latches input data IN (the first group channel data) in response to a corresponding latch clock signal of latch clock signals LATCLK<j> for latching the first group channel data (j=1 through i). An input clock signal ICLK is generated after all the first group channel data is latched. When the input clock signal ICLK is generated, the data (the first group channel data) in the first latch 611 is transmitted to the second latch 612. Next, latch clock signals LATCLK<i+1>, LATCLK<i+2>, . . . are sequentially generated to latch another group of channel data (second group channel data), and the first latch 611 latches the input data IN (the second group channel data) in response to a corresponding latch clock signal latch clock signals LATCLK<j>(j=i+1, i+2, . . . ) for latching the second group channel data.

Figure 8B:
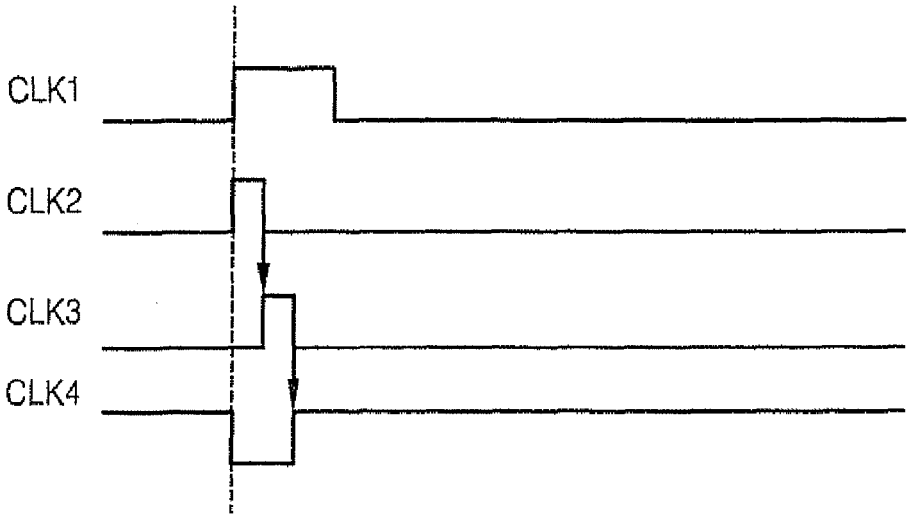

FIG. 8B is a timing diagram for explaining how data latched by the 1-bit data latch unit 600 is output according to some embodiments of the present invention.

Outputting channel data latched by the 1-bit data latch unit 600 to a decoder will now be described with reference to FIGS. 6 and 8B. The 1-bit data latch unit 600 sequentially outputs first group channel data and second group channel data based on a main output clock signal CLK1. For the sequential output of the first and second group channel data, first through third output clock signals CLK2, CLK3, and CLK4 are generated based on the main output clock signal CLK1 in the chip. As illustrated in FIG. 8B, the first through third output clock signal CLK2, CLK3, and CLK4 are sequentially activated in response to the main output clock signal CLK1.

The third latch 613 latches data from the second latch 612 and outputs the latched data in response to the first output clock signal CLK2. That is, the first group channel data stored in the second latch 612 is output to the corresponding decoder 330*a* in response to the first output clock signal CLK2.

The second latch 612 latches data (the second group channel data) in the first latch 611 in response to the second output clock signal CLK3. Thus, the data in the first latch 611 is transmitted to the second latch 612 in response to the second output clock signal CLK3. The switch 621 is turned on in response to the third output clock signal CLK4. Thus, the data (the second group channel data) in second latch 612 is output to the corresponding decoder 330*b* via the switch 621 in response to the third output clock signal CLK4.

The operation of a data latch unit for third and fourth group channel data may be the same as that of the data latch unit for the first and second group channel data and will not be described again.

The number of data latches included in a data latch unit according to some embodiments of the present invention may, therefore, be ¾ times less than that of conventional data latches in a data latch unit.

Figure 7:
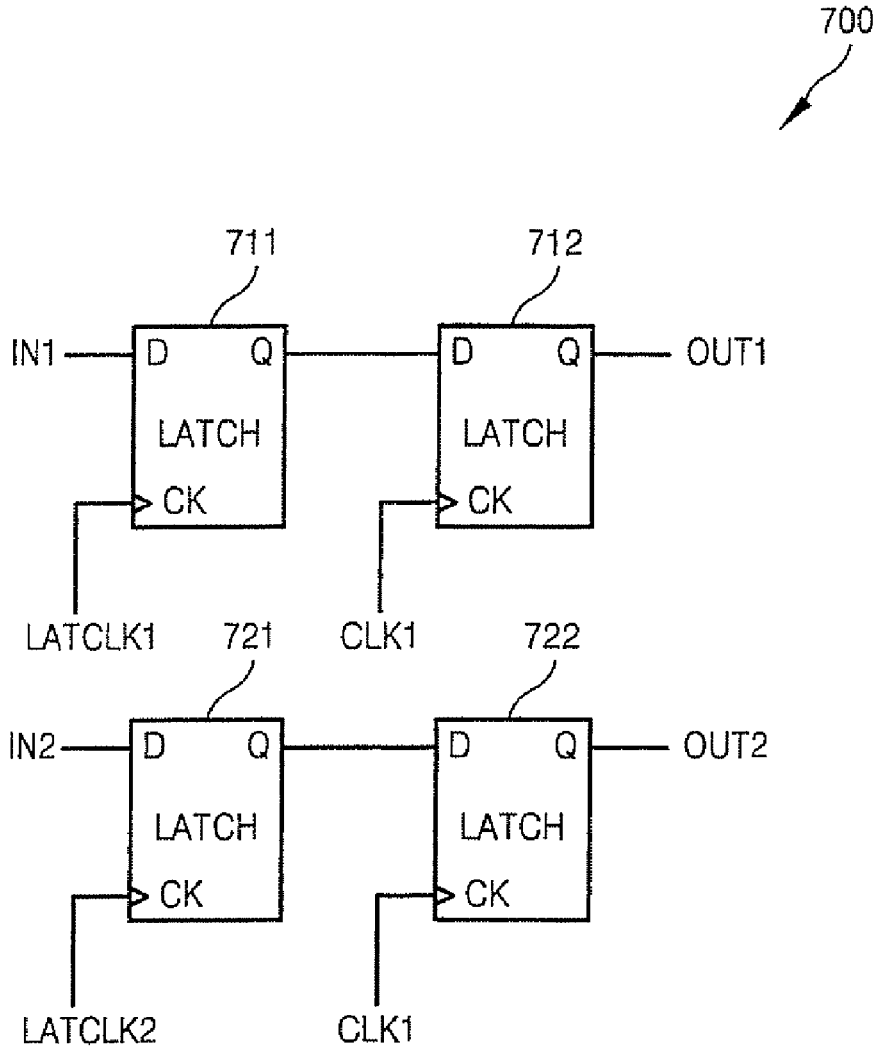
FIG. 7(PRIOR ART)
FIG. 7 is a circuit diagram of a conventional data latch unit.

FIG. 7 is a circuit diagram of a conventional data latch unit 700. Referring to FIG. 7, in the data latch unit 700, a data latch unit of an upper block is constructed to be separated from a data latch unit of a lower block.

In this case, as illustrated in FIG. 7, the data latch unit 700 may require latch units 711 and 712 that latch first group channel data IN1, and latch units 721 and 722 that latch second group channel data IN2. That is, the data latch unit 700 may require the latches 711 and 712 that respectively latch and output the first and second group channel data IN1 and IN2 in response to corresponding latch clock signals LATCLK1 and LATCLK2, and the latches 712 and 722 that respectively latch the data from the latches 711 and 721 in response to a main clock signal CLK1.

As described above, according to some embodiments of the present invention, major circuits (a shift register unit, a data unit, a decoder, an output buffer, etc.) of an LDI may be dispersed in upper and lower blocks to reduce the lengths of long edges of the chip. Also, the upper and lower blocks may share a shift register and/or a data latch, which may reduce the chip area. Accordingly, an LDI according to some embodiments of the present invention can have a small chip area and thus can have improved output characteristics between channels.

In the drawings and specification, there have been disclosed embodiments of the invention and, although specific terms are employed, they are used in a generic and descriptive sense only and not for purposes of limitation, the scope of the invention being set forth in the following claims.

What is claimed is:

1. A driver integrated circuit for a liquid crystal display, comprising:

a first shift register unit;

a first data latch unit configured to receive and store first group channel data and second group channel data in response to a clock signal generated by the first shift register unit;

a first decoder configured to receive the first group channel data and to output gamma voltages corresponding to the first group channel data;

a second decoder configured to receive the second group channel data and to output gamma voltages corresponding to the second group channel data;

a first output buffer being arranged along a first long edge of the driver integrated circuit, the first output buffer configured to buffer the gamma voltages corresponding to the first group channel data so as to drive corresponding channels of the liquid crystal display; and a second output buffer being arranged along a second long edge of the driver integrated circuit, the second output buffer configured to buffer the gamma voltages corresponding to the second group channel data so as to drive corresponding channels of the liquid crystal display;

a second shift register unit;

a second data latch unit configured and store third group channel data and fourth group channel data in response to a clock signal generated by the second shift register unit;

a third decoder configured to receive the third group channel data and to output gamma voltages corresponding to the third group channel data;

a fourth decoder configured to receive the fourth group channel data and to output gamma voltages corresponding to the fourth group channel data;

a third output buffer being arranged with respect to the second output buffer in a line, the third output buffer configured to buffer the gamma voltages corresponding to the third group channel data so as to drive corresponding channels of the liquid crystal display; and a fourth output buffer being arranged with respect to the first output buffer in a line, the fourth output buffer configured to buffer the gamma voltages corresponding to the fourth group channel data so as to drive corresponding channels of the liquid crystal display, wherein the first decoder and the first output buffer correspond to a first block, wherein the second decoder and the second output buffer correspond to a second block, wherein the first shift register unit and/or the first data latch unit are shared by the first block and the second block, wherein the first shift register unit comprises a bidirectional shift register and works for the first block during shifting in a first direction and works for the second block during shifting in a second direction, wherein the second shift register unit is configured to shift in a first direction to generate a third latch clock signal, and changed to shift in a second direction to generate a fourth latch clock signal, wherein a total bit value L of the first and second shift register units is:

$$L = \lceil n/(k \times 2) \rceil + r,$$

wherein n denotes the number of channels corresponding to the first through fourth group channel data, k denotes the number of channels that are input at a time, and r denotes a redundancy bit value.

2. The driver integrated circuit of claim 1, wherein the first shift register unit is configured to shift in a first direction to generate a first latch clock signal, and changed to shift in a second direction to generate a second latch clock signal.

3. The driver integrated circuit of claim 2, wherein the shifting direction of the first shift register unit is changed in response to a direction control signal which is generated in the driver integrated circuit.

4. The driver integrated circuit of claim 2, wherein the first shift register unit comprises (i+1) bit shift registers, and is configured to perform sequential bit shifting in the first direction from a first shift register to an $i+1^{th}$ bit shift register, and sequential bit shifting the second direction from the $i-1^{th}$ bit shift register to the first shift register.

5. The driver integrated circuit of claim 2, wherein the first data latch unit is configured to receive the first group channel data and to output the first group channel data to the first decoder in response to the first latch clock signal, and is configured to receive the second group channel data and to output the second group channel data to the second decoder in response to the second latch clock signal.

6. The driver integrated circuit of claim 5, wherein the first data latch unit comprises a first latch and a second latch, the first data latch unit configured to store the first group channel data in the first latch in response to the first latch clock signal, to transmit the first group channel data stored in the first latch to the second latch in response to a first input clock signal, to store the second group channel data in the first latch in response to the second latch clock signal, and to sequentially output the first group channel data and the second group channel data in response to a main output control signal.

7. The driver integrated circuit of claim 1, wherein the redundancy bit value is 1 or 2.

8. A driver integrated circuit for a liquid crystal display, comprising:

a first shift register unit;

a first data latch unit configured to receive and store first group channel data and second group channel data in response to a clock signal generated by the first shift register unit;

a first decoder configured to receive the first group channel data and to output gamma voltages corresponding to the first group channel data;

a second decoder configured to receive the second group channel data and to output gamma voltages corresponding to the second group channel data;

a first output buffer being arranged along a first long edge of the driver integrated circuit, the first output buffer configured to buffer the gamma voltages corresponding to the first group channel data so as to drive corresponding channels of the liquid crystal display; and a second output buffer being arranged along a second long edge of the driver integrated circuit, the second output buffer configured to buffer the gamma voltages corresponding to the second group channel data so as to drive corresponding channels of the liquid crystal display;

wherein the first decoder and the first output buffer correspond to a first block, wherein the second decoder and the second output buffer correspond to a second block, wherein the first shift register unit and/or the first data latch unit are shared by the first block and the second block, wherein the first shift register unit comprises a bidirectional shift register and works for the first block during shifting in a first direction and works for the second block during shifting in a second direction, wherein the first shift register unit is configured to shift in a first direction to generate a first latch clock signal, and changed to shift in a second direction to generate a second latch clock signal, wherein the first data latch unit is configured to receive the first group channel data and to output the first group channel data to the first decoder in response to the first latch clock signal, and is configured to receive the second group channel data and to output the second group channel data to the second decoder in response to the second latch clock signal, wherein the first data latch unit comprises first through third latches and a switch, the first data latch unit configured to store the first group channel data in the first latch in response to the first latch clock signal, to transmit the first group channel data stored in the first latch to the second latch in response to an input clock signal, to store the second group channel data in the first latch in response to the second latch clock signal, to transmit the first group channel data stored in the second latch to the third latch in response to a first output clock signal, to transmit the second group channel data stored in the first latch to the second latch in response to a second output clock signal, and to output the second group channel data stored in the second latch via the switch in response to a third output clock signal, wherein the first latch clock signal, the input clock signal, and the second latch clock signal are sequentially activated, and wherein the first output clock signal, the second output clock signal, and the third output clock signal are sequentially activated in response to the main output clock signal.

9. A driver integrated circuit for a liquid crystal display, comprising:

a rectangular driver integrated circuit chip for the liquid crystal display that includes first and second opposing long edges and first and second opposing short edges;

a first output buffer for the liquid crystal display in the rectangular driver integrated circuit chip that is adjacent, and extends along, the first long edge, the first output buffer corresponding to a first block;

a second output buffer for the liquid crystal display in the rectangular driver integrated circuit chip that is adjacent, and extends along, the second long edge, the second output buffer corresponding to a second block; and a first data latch unit configured to receive and store first group channel data corresponding to the first block and second group channel data corresponding to the second block in response to a clock signal generated by a first shift register unit, wherein the first data latch unit is shared by the first block and the second block, wherein the first data latch unit comprises first through third latches and a switch, the first data latch unit configured to store the first group channel data in the first latch in response to a first latch clock signal, to transmit the first group channel data stored in the first latch to the second latch in response to an input clock signal, to store the second group channel data in the first latch in response to a second latch clock signal, to transmit the first group channel data stored in the second latch to the third latch in response to a first output clock signal, to transmit the second group channel data stored in the first latch to the second latch in response to a second output clock signal, and to output the second group channel data stored in the second latch via the switch in response to a third output clock signal, wherein the first latch clock signal, the input clock signal, and the second latch clock signal are sequentially activated, and wherein the first output clock signal, the second output clock signal, and the third output clock signal are sequentially activated in response to the main output clock signal.

10. The driver integrated circuit of claim 9 further comprising:

a first decoder and a second decoder for the liquid crystal display in the rectangular driver integrated circuit chip between the first and second output buffers; and a data latch and a shift register for the liquid crystal display in the rectangular driver integrated circuit chip between the first and second decoders.

11. The driver integrated circuit of claim 9 further comprising:

a first decoder and a second decoder for the liquid crystal display in the rectangular driver integrated circuit chip between the first and second output buffers;

a first data latch and a second data latch for the liquid crystal display in the rectangular driver integrated circuit chip between the first and second decoders; and a first shift register and a second shift register for the liquid crystal display in the rectangular driver integrated circuit chip between the first and second data latches.

12. The driver integrated circuit of claim 9 wherein the first and second output buffers in the rectangular driver integrated circuit chip are also adjacent the first short edge, and wherein the driver integrated circuit further comprises:

a third output buffer for the liquid crystal display in the rectangular driver integrated circuit chip that is adjacent, and extends along, the first long edge; and a fourth output buffer for the liquid crystal display in the rectangular driver integrated circuit chip that is adjacent, and extends along, the second long edge;

wherein the third and fourth output buffers in the rectangular driver integrated circuit chip are also adjacent the second short edge.

* * * * *